United States Patent [19]

Kiyono

[11] 3,952,278

[45] Apr. 20, 1976

[54] COMBINATION OF A SWITCH AND VARIABLE RESISTOR

[75] Inventor: Tetsuhiro Kiyono, Wakuya, Japan

[73] Assignee: Alps Electric Co., Ltd., Tokyo, Japan

[22] Filed: Oct. 29, 1973

[21] Appl. No.: 410,435

[30] Foreign Application Priority Data

Oct. 28, 1972 Japan ..... 47-124575

[52] U.S. Cl. ..... 338/198; 200/153 R; 338/172

[51] Int. Cl.[2] ..... H01C 10/50; H01H 3/54

[58] Field of Search ..... 200/6 B, 6 BA, 6 BB, 200/6 C, 14, 17 R, 153 K, 154, 239, 244, 250, 284, 290, 336, 153 R, 307; 338/167, 168, 170, 191, 198, 199, 200, 202, 215, 172–174

[56] References Cited

UNITED STATES PATENTS

| | | | |
|---|---|---|---|
| 1,816,813 | 8/1931 | Angelides | 200/153 K UX |
| 2,073,141 | 3/1937 | Chaney | 200/153 K UX |
| 2,531,186 | 11/1950 | Yardney et al. | 338/198 X |
| 2,605,367 | 7/1952 | Cochran | 200/6 BB |
| 2,626,334 | 1/1953 | Koenig | 200/6 BB X |
| 2,739,198 | 3/1956 | Happe et al. | 200/250 X |
| 2,855,490 | 10/1958 | Arisman et al. | 338/172 |
| 3,290,456 | 12/1966 | Meyer | 200/307 X |
| 3,375,446 | 3/1968 | Guyton | 338/198 X |
| 3,567,876 | 3/1971 | Zdanys, Jr. | 338/198 UX |
| 3,845,447 | 10/1974 | Ashiya et al. | 338/172 X |

*Primary Examiner*—James R. Scott
*Attorney, Agent, or Firm*—Eliot S. Gerber

[57] ABSTRACT

An electrical switch to be used with a variable resistor, rotary switch or the like, includes a switching member slidably mounted, as a friction clutch arrangement, on the same common operating shaft as operates the resistor or rotary switch. The switching member is rotated when the operating shaft rotates so that the switching is effected and at the same time the common shaft regulates a resistance value or the like. When the operating shaft is not being rotated, the switching member is maintained in a neutral position by springs.

1 Claim, 5 Drawing Figures

1
2
3
4
5
6
7
8
10
11
12
13
14
15
16
III

COMBINATION OF A SWITCH AND VARIABLE RESISTOR

The present invention relates to an electrical switch and, in particular, to a switch which shares a common shaft with a variable resistor, rotary switch or the like.

It is a primary objective of the invention to provide an electrical switch which is characterized by the fact that a switching member is mounted on an operating shaft with a frictional force to form a slip clutch arrangement. When the common operating shaft is rotated, the switching member is caused to rotate and the switch is operated, and at the same time a slider attached to the common shaft regulates the resistance value or the like. The common operating shaft may be continued to be rotated while switching is being effected. On the other hand when the operating shaft is not being rotated, the switching member is kept in its neutral position.

It is also an objective of the present invention that the mechanism of the switch be simple so that it may be relatively low in cost and yet reliable in operation.

Two preferred embodiments of the present invention will be hereinafter described with reference to the accompanying drawings, in which.

Figures 1, 2:
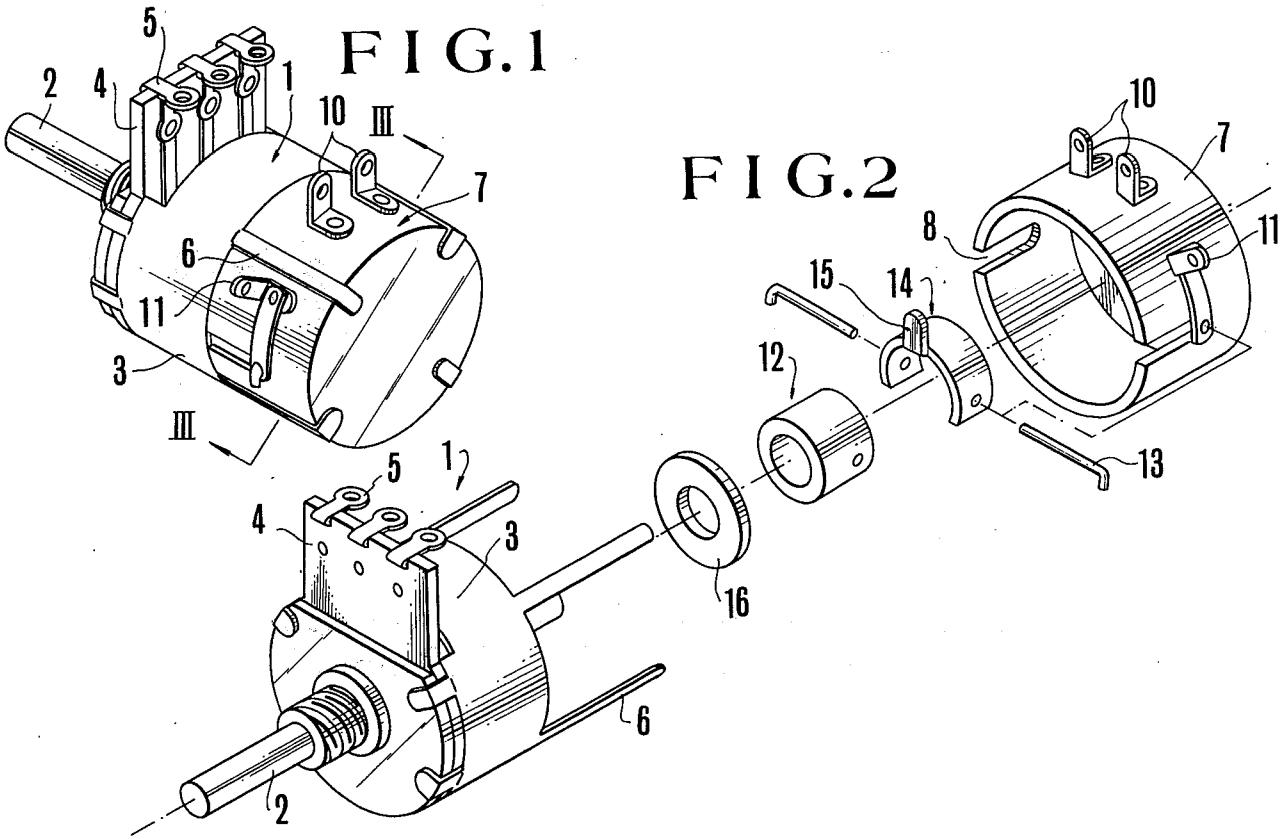
FIG. 1 is a perspective view showing the first embodiment of the present invention in which a switch according to the present invention is attached to a variable resistor and shares a common operating shaft with a variable resistor.
FIG. 2 is an exploded, perspective view of the embodiment of FIG. 1.
Figure 3:
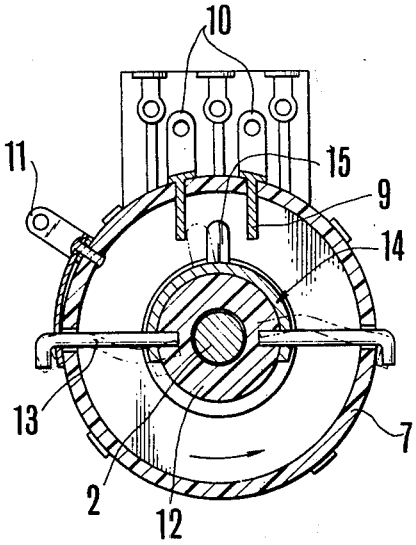
FIG. 3 is a sectional front view of the embodiment of FIG. 1.

Referring now to FIGS. 1–3, the numeral 1 is a body (housing) of a variable rotary resistor (sometimes called a "potentiometer" or "pot") of a rotary resistor of conventional construction. It includes an operating shaft 2, a cover 3, preferably of insulative plastic resin, an insulating base plate 4, terminals 5 and an internal resistor body and slider fixed to shaft 2 (the resistor and slider not being shown). The cover 3 is provided with extending fingers 6,6. The numeral 7 designates a cover (housing) of the switch, the cover being preferably of insulative plastic resin. The cover 7 is formed with plural slots 8,8, and fixed contacts 9,9 are provided inside the cover 7. The numerals 10, 10 and 11 designate external terminals. The external terminals 10,10 are integral with and are conductively connected to the fixed contacts 9,9. The external terminal 11 is in conductive contact with one of spring members 13 as will be described later. The numeral 12 is a switching member, having a body portion made of an insulating synthetic plastic resin or the like and shaped as a bushing. The switching member 12 and the operating shaft 2 have, between them, a constant frictional force, and rotate together but are so adapted that they slip under a certain pressure; that is they form a slip clutch arrangement. Preferably grease may be interposed between the operating shaft 2 and the bore of the switching member 12. The numerals 13, 13 designate spring members, which are made of a piano wire, and one of which (in contact with external terminal 11) serves as a conductive member. Each end of the two spring members 13, 13 are mounted on said switching member 12 by a forced fitting through a movable contact 14 (which will be described later). The other ends of spring members 13, 13 are located in the slots 8,8 of said cover 3.

The outer end of one of the spring members 13 made of a conductive material is in conductive contact with movable contact 14. The movable contact 14, of metal, is provided with a projection 15, at about the center of the movable contact 14, said projection 15 serving to change-over the switch in contacting and leaving the two fixed contacts 9,9. The movable contact 14 is mounted on the insulative switching member 12 by means of spring members 13, 13. The numeral 16 shows a spacer. The elastic force of the spring members 13,13 centers the projection 15 between the two fixed contacts 9,9 (the neutral position).

Now, the operation of the present invention will be described. When the operating shaft 2 is not operated (neutral position) as shown in FIG. 3, the movable contact 14 is located at the center of the fixed contacts 9,9, and the switch is in an OFF state. Next, when the operating shaft 2 is rotated in the direction of the arrow shown in the same drawing (counter clockwise) the switching member rotates in the same direction (counter clockwise) by a frictional force and the movable contact 14 comes in contact with one of the fixed contacts 9, 9, and the switch is in an ON state. By rotating the operating shaft 2 further in the same direction, the switching member 12 slips while keeping the ON state. At the same time, i.e, while there is slip between operating shaft 2 and switching member 12, the slider fixed to the operating shaft may turn on the resistor body to regulate the resistance. When the optional resistance regulation is finished and the rotation of the operating shaft 2 is stopped, the switching member slips on the operating shaft 2 by the elastic force of the spring members 13, 13 to resume its original position (neutral), the projection 15 leaves from the fixed contact 9, and the switch resumes its OFF state. The switching body consequently will return to its neutral position without disturbing the resistance regulation, i.e., without rotation of the operating shaft.

When the switch is incorporated with, for example, a variable resistance for varying voltage of an electronic tuner, and the switch of the present invention is connected to a lamp indicating the dial, it is possible to put on the lamp only during the rotation of the operating shaft of the variable resistor, that is, during tuning. Also when the switch is assembled with a rotary switch (instead of a variable resistor) and used as a function switch of a stereo device, and utilizing the switch of the present invention as a ground for preventing noise, the switch is grounded only during rotation of the operating shaft of the rotary switch, that is, only when switching sections, and the production of noise during switching of sections is prevented.

In the present invention, as stated above, the switch is operated only when the operating shaft is being rotated. The switch of the present invention may be attached to a variable resistor, a rotary switch, etc., so that a lamp is lighted only during tuning, and the switch can be utilized for preventing noise.

Figure 4:
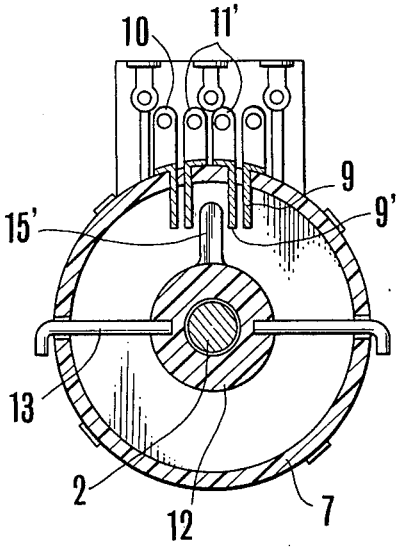
FIG. 4 is a sectional front view showing a second embodiment of the present invention.
Figure 5:
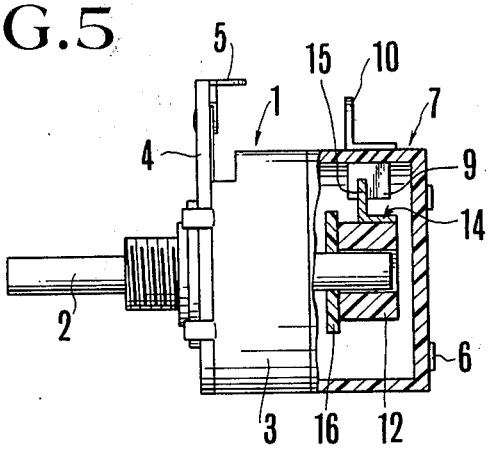
FIG. 5 is a sectional side view of the embodiment of FIG. 1.

Furthermore, FIG. 4 shows another embodiment of the present invention. In this embodiment, the movable contact 14, shown in FIG. 3 and described above, is eliminated and an insulative projection 15′ is provided as an integral portion of, or a separate piece fixed to, the switching member 12. A second contact 9' is newly provided on the switch cover 7. The spring-like flexible second contact 9' and the fixed contact 9 are brought into contact by means of the projection 15' so as to effect the switching operation. In this case, too, the same effects can be obtained as in the previous embodiment. In this embodiment the numerals 11', 11' designate external terminals.

What is claimed is:

1. The combination of a switch and variable resistor comprising a. a switch housing having a plurality of contact members, b. an operating shaft of said variable resistor in common with said switch, said shaft projected into said switch housing, c. a switching member within said housing comprising a collar constructed of electrically insulative material, and collar being mounted on said operating shaft with sliding friction therebetween, d. a projection member constructed of electrically conductive material and located on said switching member, e. spring means comprising electrically conductive and resilient wire, one end of said spring means being attached to said switching member and electrically connected to said projection, said spring means having an opposite end which extends through an aperture in said housing, said spring means centering said projection member between said contact members, f. said switching member being rotated upon initial rotation of said shaft and said variable resistor, so that said projection member comes into contact with one of said contact members, g. upon further rotation, said operating shaft overcomes the sliding friction between said operating shaft and said switching member causing a slippage therebetween so that said switching member does not rotate further and said projection member remains in contact with one of said contact members during said further rotation of said shaft and said variable resistor, h. said spring means thereafter restoring said switching member to its center position when the rotation of said operating shaft and said variable resistor is ceased.

* * * * *